US008334828B2

(12) United States Patent
Lin et al.

(10) Patent No.: US 8,334,828 B2
(45) **Date of Patent: *Dec. 18, 2012**

(54) CIRCUIT FOR AMPLIFYING A DISPLAY SIGNAL TO BE TRANSMITTED TO A REPAIR LINE BY USING A NON-INVERTING AMPLIFIER AND LCD DEVICE USING THE SAME

(75) Inventors: Feng-Shou Lin, Hsin-Chu (TW); Kuan-Yu Chen, Hsin-Chu (TW); Kuo-Liang Shen, Hsin-Chu (TW); Chien-Yu Yi, Hsin-Chu (TW)

(73) Assignee: Au Optronics Corp., Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/182,637

(22) Filed: Jul. 14, 2011

(65) Prior Publication Data

US 2011/0279440 A1 Nov. 17, 2011

Related U.S. Application Data

(63) Continuation of application No. 11/637,762, filed on Dec. 13, 2006, now Pat. No. 7,999,774.

(30) Foreign Application Priority Data

Dec. 16, 2005 (TW) ..... 94144682 A

(51) Int. Cl.
*G09G 3/36* (2006.01)

(52) U.S. Cl. ..... 345/87; 345/50; 345/98; 345/212

(58) Field of Classification Search ..... 345/50, 345/53, 87–102, 104, 204, 208–214; 349/54, 349/192

See application file for complete search history.

(56) References Cited

U.S. PATENT DOCUMENTS

| | | | | |
|---|---|---|---|---|
| 6,317,121 | B1 | 11/2001 | An | |
| 6,525,705 | B1 * | 2/2003 | Ishii et al. | 345/87 |
| 7,432,904 | B2 | 10/2008 | Kang | |
| 7,436,381 | B2 * | 10/2008 | Kim et al. | 345/87 |
| 7,501,893 | B2 | 3/2009 | Dobashi et al. | |
| 7,642,620 | B2 | 1/2010 | Tanaka | |
| 7,675,495 | B2 * | 3/2010 | Rao et al. | 345/87 |
| 7,750,899 | B2 * | 7/2010 | Miyata et al. | 345/206 |
| 7,999,774 | B2 * | 8/2011 | Lin et al. | 345/87 |
| 2003/0052659 | A1 | 3/2003 | Monomoushi et al. | |
| 2005/0110738 | A1 * | 5/2005 | Kim et al. | 345/100 |
| 2005/0195182 | A1 | 9/2005 | Tahata | |

FOREIGN PATENT DOCUMENTS

| | | | |
|---|---|---|---|
| CN | 1421757 | A | 6/2003 |
| CN | 1661427 | A | 8/2005 |
| JP | 2000-200069 | A | 7/2000 |

* cited by examiner

*Primary Examiner* — William Boddie
*Assistant Examiner* — Mansour M Said
(74) *Attorney, Agent, or Firm* — Bacon & Thomas, PLLC

(57) ABSTRACT

A circuit for amplifying a display signal transmitted to a repair line by using a non-inverting amplifier is disclosed, which comprises a voltage follower, a non-inverting amplifier, a repair line, a thin film transistor (TFT) and a liquid crystal (LC) capacitor. The voltage follower is electrically connected to a data driver chip to thereby provide a display signal to the non-inverting amplifier. The non-inverting amplifier amplifies the display signal to thus obtain an amplified display signal, and transmits the amplified display signal to the TFT and the LC capacitor through the repair line. The amplified display signal is kept at a desired voltage level when the LC capacitor receives the amplified display signal.

8 Claims, 5 Drawing Sheets

CIRCUIT FOR AMPLIFYING A DISPLAY SIGNAL TO BE TRANSMITTED TO A REPAIR LINE BY USING A NON-INVERTING AMPLIFIER AND LCD DEVICE USING THE SAME

CROSS REFERENCE TO RELATED APPLICATIONS

The present application is a Continuation application of U.S. patent application Ser. No. 11/637,162, filed Dec. 13, 2006.

BACKGROUND OF THE INVENTION

1. Field of the Invention

The invention relates to a technical field of liquid crystal display (LCD) panels and, more particularly, to a circuit for amplifying a display signal to be transmitted to a repair line by using a non-inverting amplifier and a liquid crystal display (LCD) device using the same.

2. Description of Related Art

FIG. 1 is a schematic illustration of an LCD panel with a repair line. The illustration includes an LCD panel 11, a first circuit board 12, a second circuit board 13, and a plurality of flexible packages 14 and 15 interposed between the LCD panel 11 and the first and the second circuit boards 12 and 13. Each flexible package 14 carries a source driver chip 141-143, and each flexible package 15 carries a gate driver chip 151-153.

As shown in FIG. 1, if a data line 171 connecting the data driver chip 141 is disconnected at point A, the display signal for the pixel before the point A is still provided by the data line 171. However, the display signal for the pixel after the point A is provided by the repair line 16 on the LCD panel 11.

Theoretically, the display signal transmitted by the data line 171 is equal to that transmitted by the repair line 16. However, the display signal transmitted by the repair line 16 is passed through the first circuit board 12 and the second circuit board 13, which causes a signal delay due to the long transmission path and the high transmission line impedance. Accordingly, in practice, the two display signals are not equal, and typically the display signal transmitted by the repair line 16 is lagged much behind that transmitted by the data line 171. In this case, insufficient charging to pixel display electrodes after the point A in a predetermined charging period may occur.

Typically, the predetermined charging period for the panel is decreased with increased resolution and increased area of the panel. The increased resolution makes the gate driver chip to have less time to turn on the TFT, and the increased area prolongs a signal transmission delay on the panel. Thus, the resolution and area of the panel can have an impact on the predetermined charging period. If the resolution of the panel is not changed, the signal transmission delay can determine a length of the predetermined charging period.

FIG. 2A is a schematic illustration of signal transmission delays occurred on the typical LCD panel 11. In FIG. 2B, it shows the delay of a display signal output by the data driver chip 144 of the region B in FIG. 2A. FIG. 2C indicates an effect of five-stage RC (resistor and capacitor) load on a metal line and ITO (indium tin oxide) glass, wherein the load generated is increased with the increased area of the LCD panel 11 of the region C in FIG. 2A. FIG. 2D shows the delay of a display signal output from the data driver chip to the TFT 21 of the region D in FIG. 2A. When a display signal is output from the data driver chip to region D, delay caused by regions B and C is included. In addition, the entire system of the LCD panel 11 can cause some delay effects, such as a transmission delay on the gate driver chip 154, an RC delay caused by an LC capacitor plus a turn-on resistor presented when an amorphous silicon metal oxide semiconductor (MOS) is turned on, and the like.

As cited, in FIGS. 1 and 2, the delay in the region C of the pixel driven by the repair line 16 on the LCD panel 11 is far greater than that generated in the pixel driven by a typical data driver chip normally. To overcome this, a solution is given by placing a unit buffer (also referring to as a voltage follower) in the data driver chip or on the first circuit board 12, which can reduce the delay. However, when an area of the LCD panel 11 is increased more and more, the transmission path of the repair line 16 on the panel 11 is prolonged more and more. Accordingly, the deformation of a display signal is increased sharply, and in this case, only using a voltage follower still has the signal deformation effect and is not enough to effectively improve the signal delay.

Therefore, it is desirable to provide an improved circuit to mitigate and/or obviate the aforementioned problems.

SUMMARY OF THE INVENTION

An object of the invention is to provide a circuit for amplifying a display signal to be transmitted to a repair line by using a non-inverting amplifier, which can overcome bright or dark lines caused by the long path of the repair line and presented on the LCD panel.

Another object of the invention is to provide a circuit for amplifying a display signal to be transmitted to a repair line by using a non-inverting amplifier, which can increase the yield on products.

In accordance with one aspect of the invention, there is provided a circuit for amplifying a display signal to be transmitted to a repair line by using a non-inverting amplifier is provided. The circuit includes a voltage follower, a non-inverting amplifier, a repair line, a thin film transistor (TFT) and a liquid crystal (LC) capacitor. The voltage follower is electrically connected to the non-inverting amplifier and outputs a display signal for a pixel. The non-inverting amplifier receives the display signal for amplifying to thus obtain an amplified display signal, wherein the display signal received has a first voltage level. The repair line has a first terminal and a second terminal, wherein the first terminal is electrically connected to the non-inverting amplifier for transmitting the amplified display signal. The TFT is electrically connected to the second terminal of the repair line for receiving the amplified display signal. The LC capacitor is electrically connected to the TFT, wherein the amplified display signal received by the LC capacitor has a second voltage level substantially equal to the first voltage level.

The TFT has a drain electrically connected to the second terminal of the repair line, and a source electrically connected to one terminal of the LC capacitor.

The circuit further includes an oscillation loop, which is electrically connected to a positive input terminal of the non-inverting amplifier for providing an overshoot voltage.

The non-inverting amplifier further includes a first resistor and a second resistor, which form a gain of 1+(R1/R2) for R1 is a resistance of the first resistor and R2 is a resistance of the second resistor. Either the first resistor or the second resistor is a variable resistor.

In accordance with another aspect of the invention, there is provided an LCD device including a data driver chip, a voltage follower, a non-inverting amplifier, a repair line, and a thin film transistor (TFT). The data driver chip provides a display signal having a current and a first voltage level. The voltage follower is connected to the data driver chip for enhancing the current of the display signal. The non-inverting amplifier receives the display signal and amplifies the display signal to provide an amplified display signal. The repair line has a first terminal and a second terminal, wherein the first terminal is electrically connected to the non-inverting amplifier for transmitting the amplified display signal. The TFT is electrically connected to the second terminal of the repair line for receiving the amplified display signal. The LC capacitor is electrically connected to the TFT, wherein the amplified display signal transmitted to the LC capacitor has a second voltage level substantially equal to the first voltage level.

In accordance with another aspect of the invention, there is provided an LCD device including a data driver chip, a non-inverting amplifier, a repair line, a thin film transistor (TFT), and a liquid crystal (LC) capacitor. The data driver chip provides a display signal having a current and a first voltage level, and the data driver chip has a voltage follower for enhancing the current of the display signal. The non-inverting amplifier receives the display signal and amplifies the display signal to provide an amplified display signal. The repair line has a first terminal and a second terminal, wherein the first terminal is electrically connected to the non-inverting amplifier for transmitting the amplified display signal. The TFT is electrically connected to the second terminal of the repair line for receiving the amplified display signal. The LC capacitor is electrically connected to the TFT, wherein the amplified display signal transmitted to the LC capacitor has a second voltage level substantially equal to the first voltage level.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
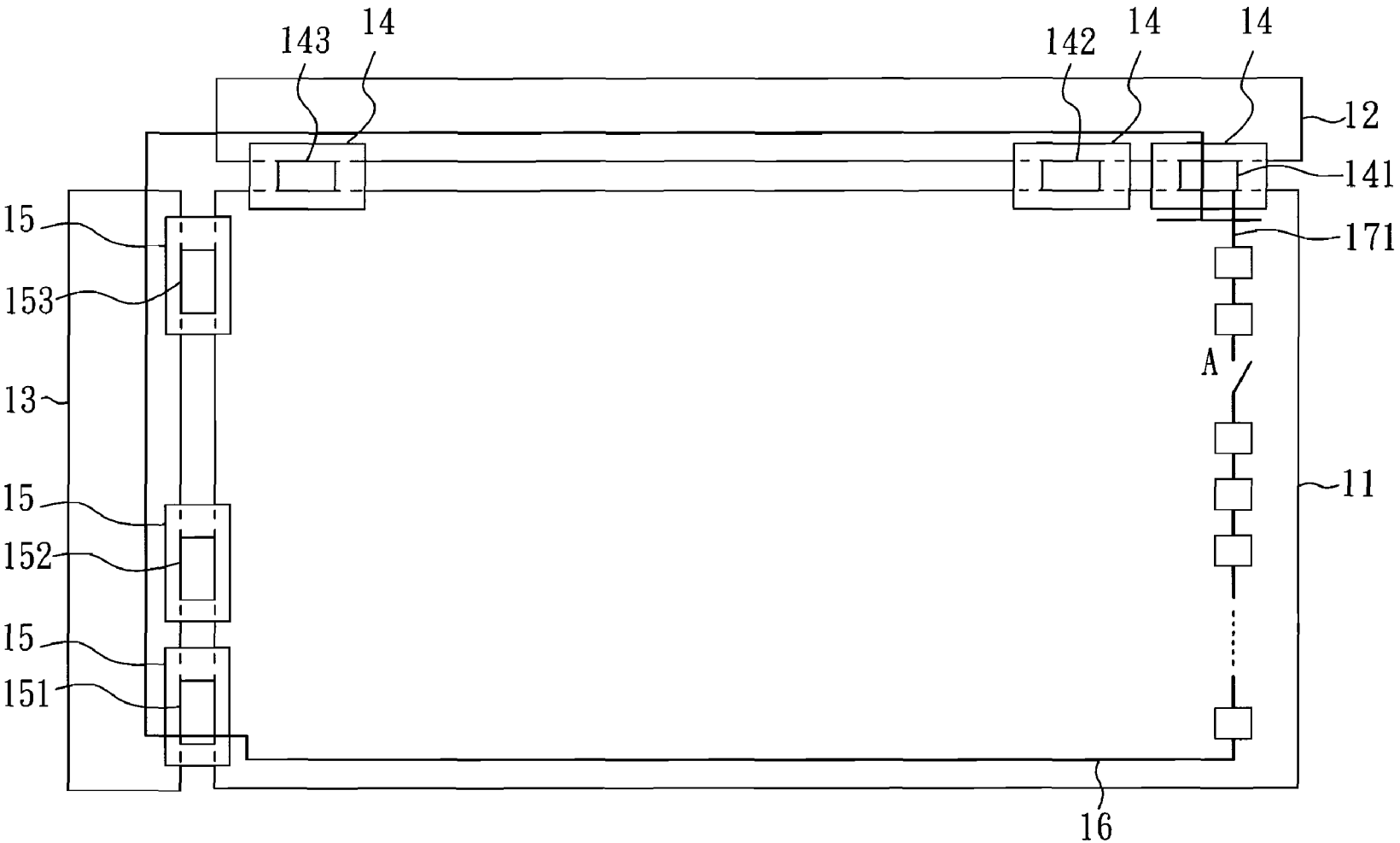
FIG. 1 (PRIOR ART)
FIG. 1 is a schematic illustration of a typical structure having a repair line implemented on an LCD panel.
Figure 2:
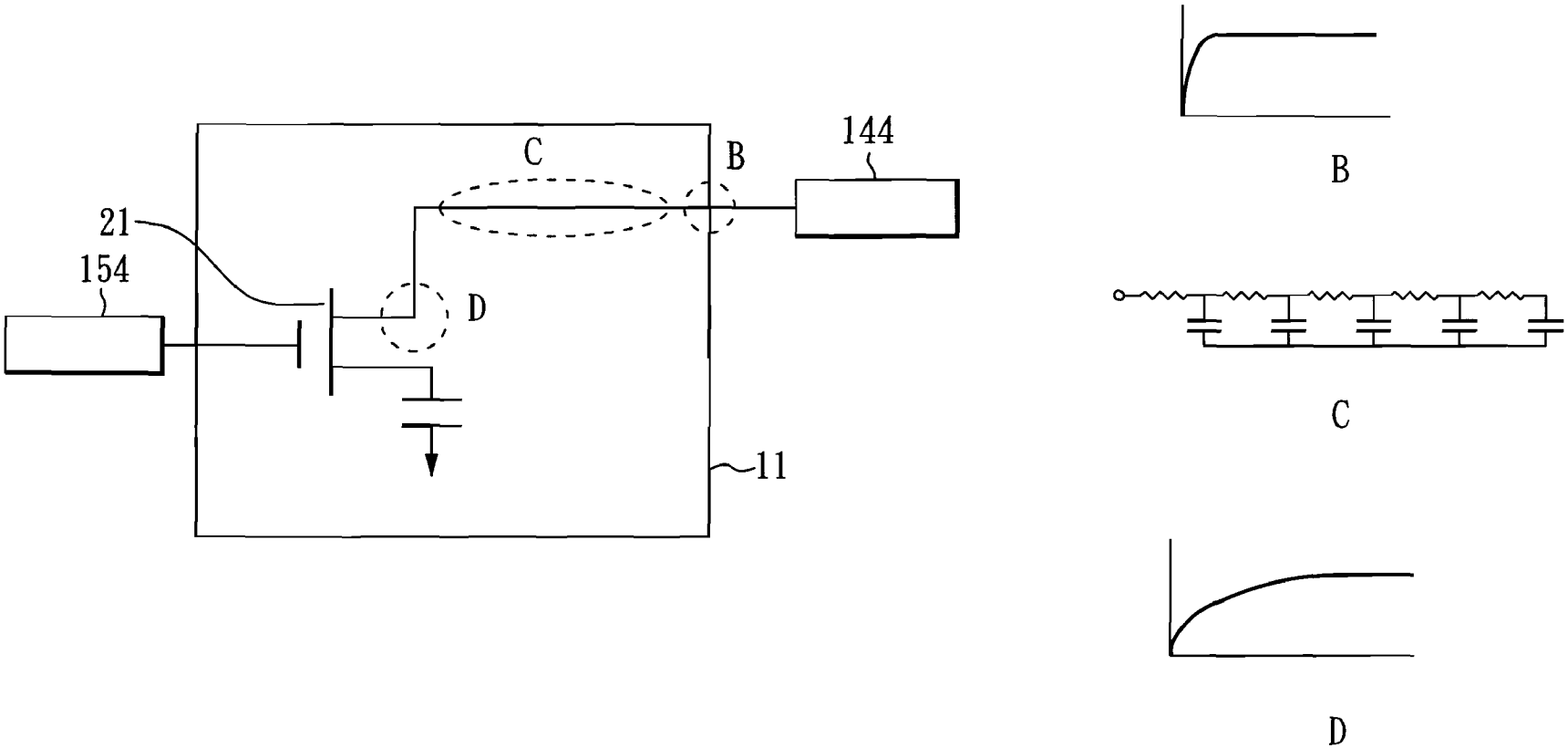
FIG. 2 (PRIOR ART)
FIG. 2 is a schematic illustration of signal transmission delays occurred on a typical LCD panel.
Figure 3A:
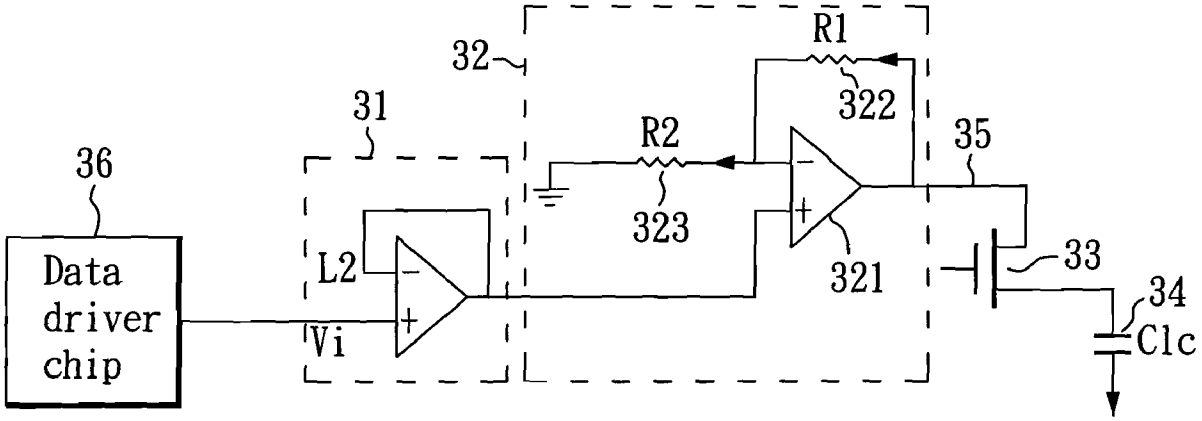
FIGS. 3A and 3B are schematic illustrations of a circuit for amplifying a display signal to be transmitted to a repair line by using a non-inverting amplifier according to a first preferred embodiment of the invention.

FIG. 3A is a schematic illustration of a circuit for amplifying a display signal to be transmitted to a repair line by using a non-inverting amplifier according to a first preferred embodiment of the invention. In FIG. 3A, the circuit includes a voltage follower 31, a non-inverting amplifier 32, a thin film transistor (TFT) 33 and a liquid crystal (LC) capacitor 34. The non-inverting amplifier 32 has an operational amplifier 321 and resistors 322 and 323 (R1, R2).

Figure 3B:
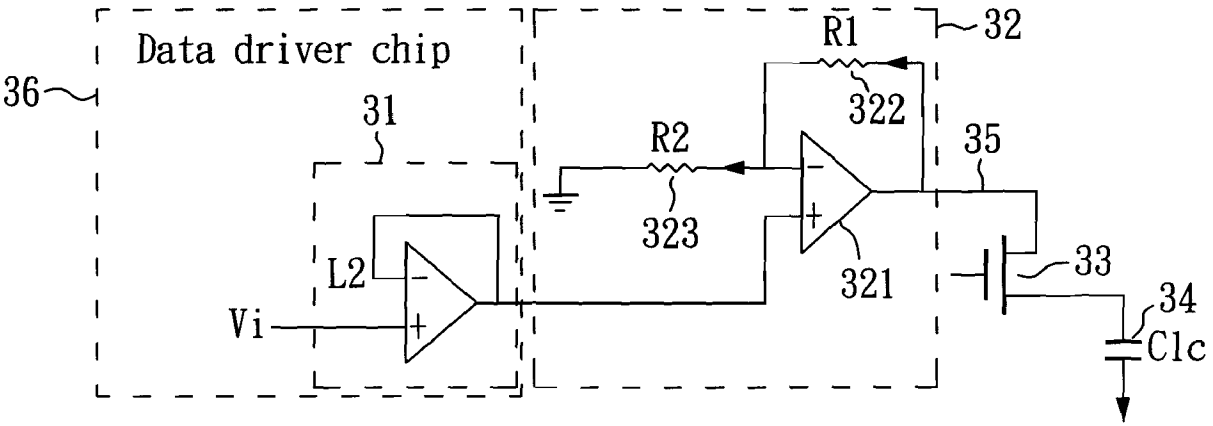

In this embodiment, the voltage follower 31 has an input terminal electrically connected to a data driver chip 36, but not limited to it. The data driver chip 36 is employed to provide a display signal. In other example, as shown in FIG. 3B, the voltage follower 31 can be implemented in the data driver chip 36, and in this case, the non-inverting amplifier 32 is electrically connected to the data driver chip 36 implemented with the voltage follower 31.

It is noted that the non-inverting amplifier 32 is located outside the data driver chip 36 in a driving circuit of the LCD panel such that an amplification of the non-inverting amplifier 32 can be adjusted as needs. For example, the non-inverting amplifier 32 can be implemented on a flexible substrate containing the data driver chip 36 or on a control circuit board containing another driving circuit, such as a timing control chip.

A repair line 35 is implemented between the non-inverting amplifier and the TFT 33. The repair line 35 has one terminal electrically connected to an output terminal of the non-inverting amplifier 32, and the other terminal electrically connected to a drain of the TFT 33. A source of the TFT 33 is electrically connected to one terminal of the LC capacitor 34.

The non-inverting amplifier 32 has a gain of $1+(R1/R2)$, and an output voltage $Vo=(1+(R1/R2))Vi$, where Vi is an input voltage of the non-inverting amplifier 32. Accordingly, it is known that for the non-inverting amplifier 32, the output voltage is greater than the input voltage ($Vo>Vi$).

In this embodiment, the resistors 322 and 323 are a variable resistor for obtaining an appropriate gain by adjusting the resistance of R1 or R2. Thus, the display signal amplified by the non-inverting amplifier 32 can reach to a desired voltage value when the LC capacitor 34 receives the amplified display signal. In addition, in other embodiments, the resistors 322 and 323 can be a fixed resistor, or one of the two is a fixed resistor and the other is a variable resistor.

The voltage follower 31 receives the display signal output by the data driver chip 36 for enhancing the output current, and outputs the display signal received to the non-inverting amplifier 32. The display signal received by the non-inverting amplifier 32 has a first voltage level.

As cited in the prior that the repair line may have a long length to thereby cause an undesired high impedance and further attenuate and delay the transmitting display signal thereon. For example, a display signal for a pixel may have a voltage level below the first voltage level, as it is transmitted to the LC capacitor 34 through the repair line 35. Accordingly, the non-inverting amplifier 32 with the feature of voltage amplification is used to amplify the display signal received, such that the amplified display signal can have a raised voltage level.

Subsequently, the non-inverting amplifier 32 provides the amplified display signal to the TFT 33 and the LC capacitor 34 through the repair line 35. In this case, since the display signal provided by the data driver chip 36 is amplified, i.e., the voltage level of the display signal for a pixel is raised, the amplified display signal received by the LC capacitor 34 has a second voltage level, which is substantially equal to the first voltage level. Thus, the signal deformation caused by the undesired high impedance of the repair line 35 is improved.

Further, in this embodiment, when the repair line 35 is not welded by a laser (because of no need), the non-inverting amplifier 32 is not operated. Conversely, when the repair line 35 is welded (for a use need), the non-inverting amplifier 32 is operated to amplify all received display signals for pixels.

Figure 4:
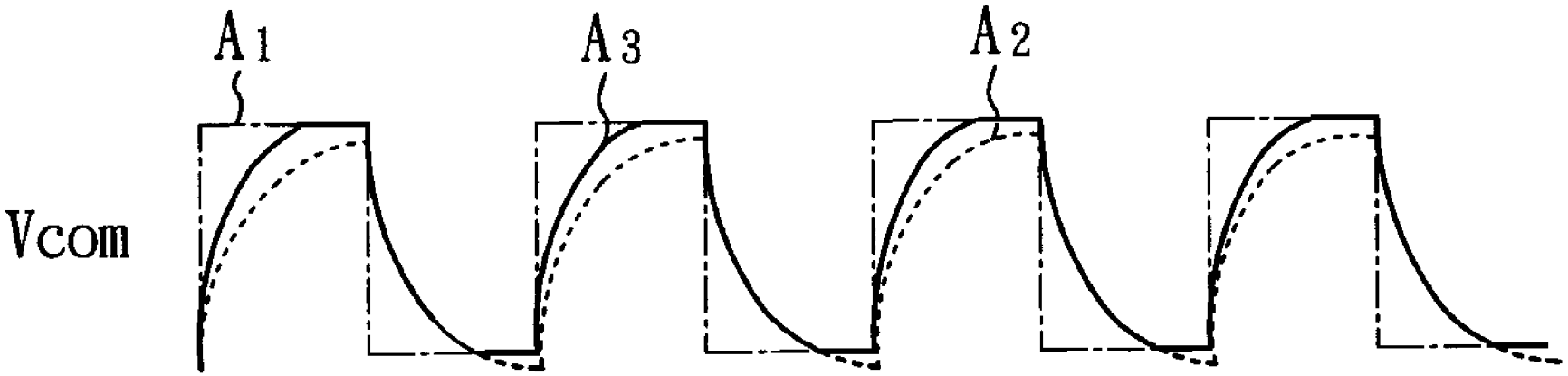
FIG. 4 is a schematic illustration of a waveform comparison of display signals for a pixel according to a first preferred embodiment of the invention.

FIG. 4 is a schematic illustration of a waveform comparison of display signals for a pixel according to a first preferred embodiment of the invention. As shown in FIG. 4, notations A1 to A3 indicate voltage waveforms Vcom of a display signal for a pixel in various conditions, wherein A1 indicates an ideal voltage waveform, A2 indicates a voltage waveform measured when the non-inverting amplifier is absent, and A3 indicates a voltage waveform measured when the non-inverting amplifier is operated.

In current large-scale LCD panels, the undesired impedance caused by a long repair line is improved by the voltage follower. However, due to the voltage level delay and the RC effect, the display signal for a pixel has a voltage waveform as shown as A2, which causes the LC capacitor to be charged insufficiently in a predetermined charging period. Accordingly, for an LCD panel, bright or dark lines are easily presented.

The non-inverting amplifier in this embodiment can amplify the display signal provided by the data driver chip 36 and transmit the amplified display signal to the LC capacitor through the repair line, and thus the amplified display signal received by the LC capacitor has a voltage waveform as shown as A3. Accordingly, the signal deformation is relatively improved.

Figure 5:
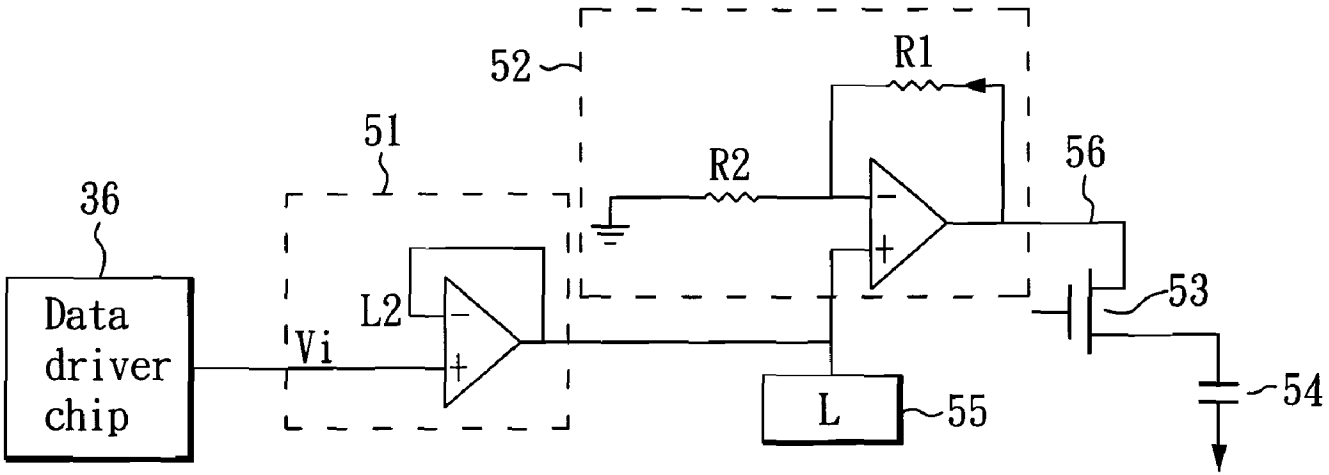
FIG. 5 is a schematic circuit according to a second preferred embodiment of the invention.

FIG. 5 is a schematic circuit according to a second preferred embodiment of the invention. In this embodiment, the circuit includes a voltage follower 51, a non-inverting amplifier 52, a thin film transistor 53 (TFT), a liquid crystal (LC) capacitor 54, an oscillation loop 55 and a repair line 56. The elements in this embodiment are identical to similar numbered ones respectively in the first embodiment, except that the positive input terminal of the non-inverting amplifier 52 is also electrically connected to the oscillation loop 55, which is absent from the first embodiment and provides an overshoot voltage such that the display signal received by the LC capacitor 54 can reach to a desired voltage level.

Figure 6:
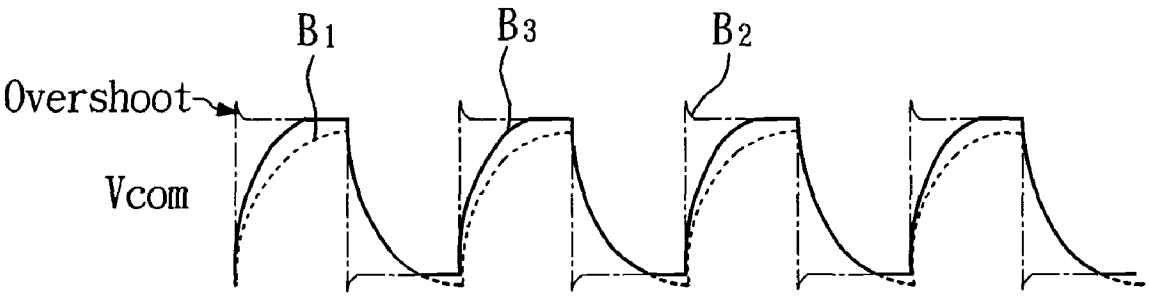
FIG. 6 is a schematic illustration of a waveform comparison of FIG. 5 according to a second preferred embodiment of the invention.

FIG. 6 is a schematic illustration of voltage waveforms according to a second preferred embodiment of the invention. As shown in FIG. 6, B1 indicates a voltage waveform of a pixel electrode of a typical LCD, B2 indicates a voltage waveform of a display signal output by the non-inverting amplifier 52 for a pixel, and B3 indicates a voltage waveform of the display signal received by the LC capacitor 54.

As cited, the invention uses the non-inverting amplifier to amplify a display signal provided by the data driver chip for a pixel, such that the display signal amplified by the non-inverting amplifier and received by the LC capacitor through the repair line can have a desired voltage level. Accordingly, the problem of insufficient charging a display electrode for a pixel due to the undesired long repair line is overcome, and dark and bright lines presented on the LCD panel due to the repair line are improved to thus increase the yield on products.

Although the present invention has been explained in relation to its preferred embodiment, it is to be understood that many other possible modifications and variations can be made without departing from the spirit and scope of the invention as hereinafter claimed.

What is claimed is:

1. A circuit for amplifying a display signal transmitted to a repair line, comprising:

a non-inverting amplifier, which receives a display signal having a first voltage level and amplifies the display signal to provide an amplified display signal, the non-inverting amplifier further comprising a first resistor and a second resistor and having a gain of 1+(R1/R2), where R1 is a resistance of the first resistor and R2 is a resistance of the second resistor;

a repair line, which has a first terminal and a second terminal, wherein the first terminal is electrically connected to the non-inverting amplifier for transmitting the amplified display signal;

a thin film transistor (TFT), which is electrically connected to the second terminal of the repair line for receiving the amplified display signal; and a liquid crystal (LC) capacitor, which is electrically connected to the TFT, wherein the amplified display signal transmitted to the LC capacitor has a second voltage level substantially equal to the first voltage level.

2. The circuit as claimed in claim 1, further comprising a voltage follower electrically connected to the non-inverting amplifier.

3. The circuit as claimed in claim 1, further comprising an oscillation loop electrically connected to a positive input terminal of the non-inverting amplifier.

4. The circuit as claimed in claim 3, wherein the oscillation loop provides an overshoot voltage.

5. The circuit as claimed in claim 1, wherein the first resistor is a variable resistor.

6. The circuit as claimed in claim 1, wherein the second resistor is a variable resistor.

7. The circuit as claimed in claim 1, wherein the second terminal of the repair line is electrically connected to a drain of the TFT.

8. The circuit as claimed in claim 1, wherein the TFT has a source electrically connected to one terminal of the LC capacitor.

* * * * *